US009080399B2

(12) United States Patent
Oesterberg

(10) Patent No.: US 9,080,399 B2
(45) Date of Patent: Jul. 14, 2015

(54) EARTH-BORING TOOLS INCLUDING RETRACTABLE PADS, CARTRIDGES INCLUDING RETRACTABLE PADS FOR SUCH TOOLS, AND RELATED METHODS

(75) Inventor: Marcus Oesterberg, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 1053 days.

(21) Appl. No.: 13/160,015

(22) Filed: Jun. 14, 2011

(65) Prior Publication Data

US 2012/0318580 A1 Dec. 20, 2012

(51) Int. Cl.
*E21B 10/32* (2006.01)
*E21B 7/06* (2006.01)
*E21B 10/62* (2006.01)

(52) U.S. Cl.
CPC ..... *E21B 10/322* (2013.01); *E21B 7/064* (2013.01); *E21B 10/62* (2013.01)

(58) Field of Classification Search
CPC ..... E21B 7/04; E21B 10/42; E21B 10/322; E21B 10/62; E21B 7/064
USPC ..... 175/61, 266, 284
See application file for complete search history.

(56) References Cited

U.S. PATENT DOCUMENTS 2,819,043 A * 1/1958 Henderson ..... 175/405.1
5,553,678 A * 9/1996 Barr et al. ..... 175/73
5,813,480 A 9/1998 Zaleski, Jr. et al.
6,089,332 A 7/2000 Barr et al.
6,230,822 B1 5/2001 Sullivan et al.
6,419,032 B1 7/2002 Sullivan et al.
6,540,033 B1 4/2003 Sullivan et al.
6,543,312 B2 4/2003 Sullivan et al.
6,571,886 B1 6/2003 Sullivan et al.
6,626,251 B1 9/2003 Sullivan et al.
7,066,280 B2 6/2006 Sullivan et al.

(Continued)

FOREIGN PATENT DOCUMENTS

WO 2006085105 A1 8/2006
WO WO 2009/101477 * 8/2009 ..... E21B 7/06

(Continued)

OTHER PUBLICATIONS

Trinkel, Bud. Fluid Power e Book—Chapter 6—Fluid Power Circuits Explained, Apr. 25, 2008.*

(Continued)

*Primary Examiner* — Kenneth L Thompson
*Assistant Examiner* — David Carroll
(74) *Attorney, Agent, or Firm* — TraskBritt

(57) ABSTRACT

An earth-boring tool may comprise at least one cavity formed in a face thereof. At least one retractable pad residing in the at least one cavity may be coupled to a piston located at least partially within the at least one cavity. Additionally, a valve may be positioned within the earth-boring tool and configured to regulate flow of an incompressible fluid in contact with the piston through an opening of a reservoir. A cartridge may comprise a barrel wall defining a first bore, and a piston comprising at least one retractable pad positioned at least partially within the first bore. The barrel wall and the piston may define a first reservoir within the first bore, and a valve may be positioned and configured to regulate flow through an opening to the first reservoir. Related methods and devices are also disclosed.

13 Claims, 12 Drawing Sheets

(56) References Cited

U.S. PATENT DOCUMENTS

| | | | | |
|---|---|---|---|---|
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 7,604,072 | B2 | 10/2009 | Pastusek et al. | |
| 7,849,934 | B2 | 12/2010 | Pastusek et al. | |
| 2002/0112887 | A1* | 8/2002 | Harrison | 175/27 |
| 2006/0272859 | A1* | 12/2006 | Pastusek et al. | 175/40 |
| 2007/0102195 | A1 | 5/2007 | Denoix | |
| 2007/0119630 | A1 | 5/2007 | Hall et al. | |
| 2007/0199739 | A1* | 8/2007 | Schwefe et al. | 175/426 |
| 2009/0008151 | A1 | 1/2009 | Turner et al. | |
| 2010/0012313 | A1* | 1/2010 | Longfield et al. | 166/66.6 |
| 2010/0071956 | A1* | 3/2010 | Beuershausen | 175/61 |

FOREIGN PATENT DOCUMENTS

| | | | |
|---|---|---|---|
| WO | 2010036834 | A2 | 4/2010 |
| WO | 2010042797 | A2 | 4/2010 |
| WO | 2010042797 | A4 | 4/2010 |

OTHER PUBLICATIONS

International Search Report for International Application No. PCT/US2012/042400, dated Feb. 27, 2013, 3 pages.

Written Opinion of the International Search Authority for International Application No. PCT/PCT/US2012/042400, dated Feb. 27, 2013, 6 pages.

International Preliminary Report on Patentability, for International Application No. PCT/US2012/042400, dated Dec. 17, 2013, 7 pages.

* cited by examiner

EARTH-BORING TOOLS INCLUDING RETRACTABLE PADS, CARTRIDGES INCLUDING RETRACTABLE PADS FOR SUCH TOOLS, AND RELATED METHODS

TECHNICAL FIELD

Embodiments of the present disclosure generally relate to earth-boring tools including retractable pads. Embodiments additionally relate to components for such earth-boring tools, such as cartridges including retractable pads, and related methods.

BACKGROUND

The trend in United States land and other unconventional oil and gas exploration is tending toward a horizontal development of oil and gas wells, where a borehole is drilled into, and then to laterally follow, a hydrocarbon-producing formation. Such horizontal development of oil and gas wells typically requires directional drilling, wherein a vertical borehole segment is drilled, followed by a curved borehole segment which, in turn, transitions to a horizontal or other borehole segment extending laterally to follow the formation. Typically the curved borehole segment is drilled with a bit having a relatively low aggressiveness, in order to provide stability and control of the tool face. In forming the lateral, or horizontal, borehole segment the operator may want to optimize the rate-of-penetration (ROP). To optimize the overall ROP using conventional bits, the operator may utilize a round trip, tripping out the bit with relatively low aggressiveness and tripping in another bit with relatively high aggressiveness. Such a round trip may be time consuming and costly due to the wasted rig time and necessity for using two different drill bits.

In view of the foregoing, improved earth-boring tools, improved earth-boring tool components, and improved drilling methods, would be desirable.

BRIEF SUMMARY

In some embodiments, an earth-boring tool may comprise at least one cavity formed in a face thereof. A retractable pad may be positioned in the at least one cavity adjacent the face and coupled to a piston located at least partially within the at least one cavity. Additionally, a substantially incompressible fluid may be in contact with the piston and contained within a first reservoir, and a valve may be positioned within the earth-boring tool and configured to regulate flow through an opening of the first reservoir.

In additional embodiments, a cartridge for an earth-boring tool may comprise a barrel wall defining a first bore and a piston comprising at least one retractable pad positioned at least partially within the first bore. Additionally, the cartridge may comprise a first reservoir within the first bore adjacent the piston, an opening to the first reservoir, and a valve positioned and configured to regulate fluid flow through the opening.

In further embodiments, an earth-boring drill bit may comprise a plurality of cavities in a face thereof, and a retractable pad coupled to a first piston located at least partially within each cavity of the plurality. The earth-boring drill bit may additionally comprise a substantially incompressible fluid in contact with the piston and contained within a first reservoir, and a plurality of bores in fluid communication with the plurality of cavities and in contact with the substantially incompressible fluid. Furthermore, a second piston may be located at least partially within each bore of the plurality of bores; and a swash plate may be operably coupled to each second piston.

In yet additional embodiments, a method of operating an earth-boring tool may comprise drilling a borehole with an earth-boring tool with at least one retractable pad protruding from a face of the earth-boring tool adjacent at least one cutting structure. The method may further comprise opening a valve within the earth-boring tool to release a fluid from a first reservoir positioned beneath the at least one retractable pad and reducing the amount of protrusion of the at least one retractable pad from the face of the earth-boring tool while within the borehole, and resuming drilling after reducing the amount of protrusion of the at least one retractable pad from the face of the earth-boring tool.

In yet further embodiments, a method of forming a curved borehole may comprise extending at least one retractable pad positioned within a face of a drill bit at a first side of a borehole while drilling, and retracting the at least one retractable pad at a second side of the borehole while drilling.

DETAILED DESCRIPTION

The illustrations presented herein are not meant to be actual views of any particular device, or related method, but are merely idealized representations which are employed to describe embodiments of the present invention. Additionally, elements common between figures may retain the same numerical designation.

Although some embodiments of the present disclosure are depicted as being used and employed in drag bits, persons of ordinary skill in the art will understand that the embodiments of the present disclosure may be employed in hybrid drill bits or other drill bit configurations. Accordingly, the term "earth-boring tool" and as used herein, means and includes any type of drill bit or other earth-boring apparatus for use in drilling or enlarging bore holes or wells in earth formations.

Figure 1:
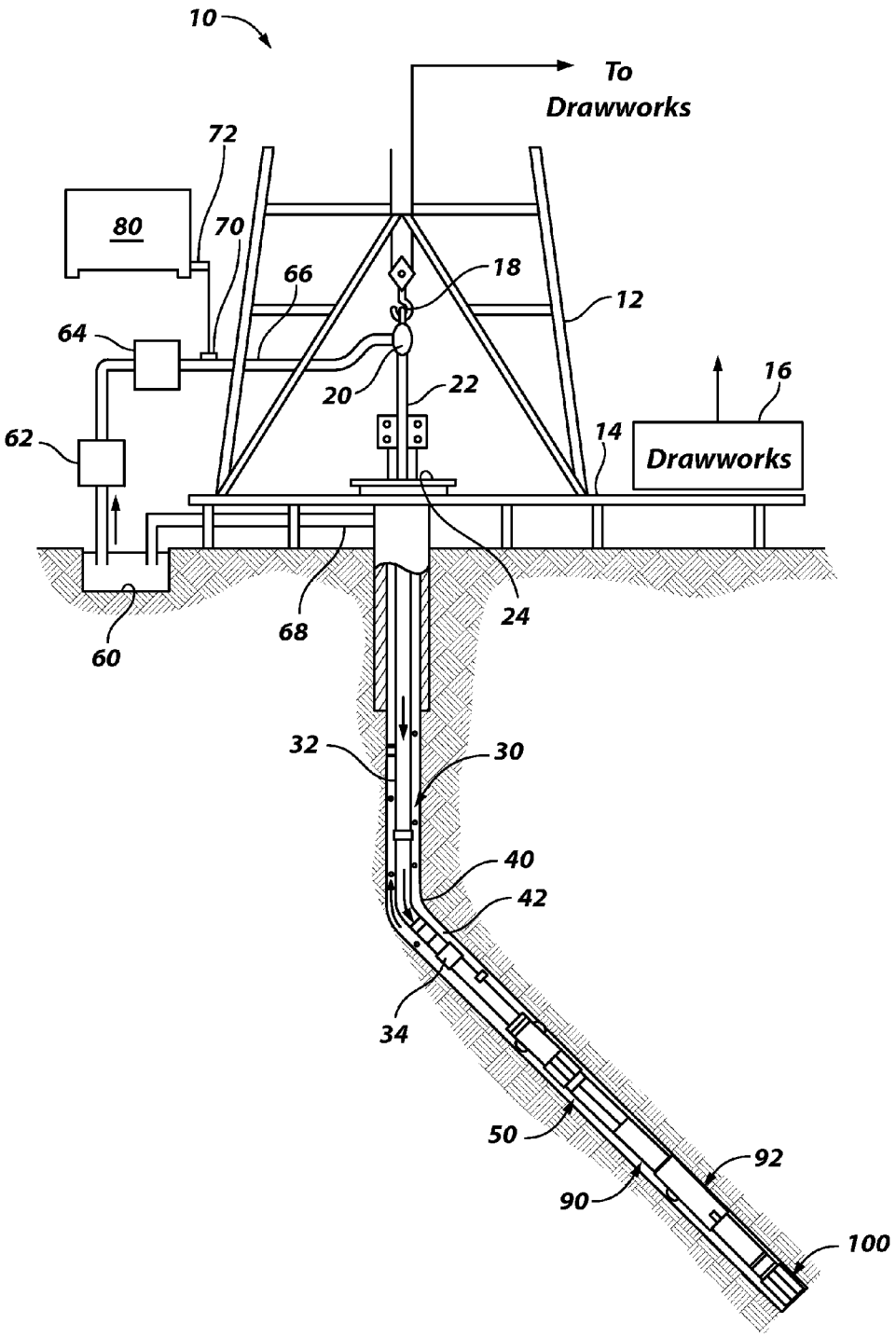
FIG. 1 shows a schematic view of a drilling rig including a drill bit in accordance with an embodiment of the present disclosure.

FIG. 1 depicts an example of an apparatus for performing subterranean drilling operations. A drilling rig 10 may include a derrick 12, a derrick floor 14, a drawworks 16, a hook 18, a swivel 20, a Kelly joint 22, and a rotary table 24. A drillstring 30, which may include a drill pipe section 32 and a drill collar section 34, extends downward from the drilling rig 10 into a borehole 40. The drill pipe section 32 may include a number of tubular drill pipe members or strands connected together and the drill collar section 34 may likewise include a plurality of drill collars. Optionally, the drillstring 30 may include a measurement-while-drilling (MWD) logging subassembly and cooperating mud pulse telemetry data transmission subassembly, which are collectively referred to as an MWD communication system 50, as well as other communication systems known to those of ordinary skill in the art.

During drilling operations, drilling fluid may be circulated from a mud pit 60 through a mud pump 62, through a desurger 64, and through a mud supply line 66 into the swivel 20. The drilling mud (also referred to as drilling fluid) flows through the Kelly joint 22 and into an axial central bore in the drillstring 30. Eventually, it exits through nozzles or other apertures, which are located in a drill bit 100, which is connected to the lowermost portion of the drillstring 30. The drilling mud flows back up through an annular space 42 between the outer surface of the drillstring 30 and the inner surface of the borehole 40, to be circulated to the surface where it is returned to the mud pit 60 through a mud return line 68.

A shaker screen (not shown) may be used to separate formation cuttings from the drilling mud before it returns to the mud pit 60. The optional MWD communication system 50 may utilize a mud pulse telemetry technique to communicate data from a downhole location to the surface while drilling operations take place. To receive data at the surface, a mud pulse transducer 70 is provided in communication with the mud supply line 66. The mud pulse transducer 70 generates electrical signals in response to pressure variations of the drilling mud in the mud supply line 66. The electrical signals are transmitted by a surface conductor 72 to a surface electronic processing system 80, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 50. Mud pulses that define the data propagated to the surface are produced by equipment conventionally located within the MWD communication system 50. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 70. An alternative conventional arrangement generates and transmits positive pressure pulses. As is conventional, the circulating drilling mud also may provide a source of energy for a turbine-driven generator subassembly (not shown) which may be located near a bottom-hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a backup for the turbine-driven generator.

For directional drilling, the drillstring 30 may include a mud motor 90 and a bent sub and/or a steering sub 92 at a location near the drill bit 100. When drilling a straight borehole segment, the steering sub 92 and the drill bit 100 may both be rotated relative to the borehole 40. In view of this, the drill bit 100 may be rotated off-center and may drill a slightly oversized borehole 40, due to the steering sub 92 rotating and rubbing along the wall of the borehole 40. Optionally, a steering pad on the steering sub 92 may be moved to a retracted position, which may allow the drill bit 100 to be rotated on-center while drilling a straight borehole segment.

When drilling a curved borehole segment, the mud motor 90 may be utilized to rotate the drill bit 100 relative to the borehole 40, while the drillstring 30 located above the mud motor 90, may not rotate relative to the borehole 40. In view of this, the drill bit 100 may be rotated on-center and the steering sub 92 may not rotate relative to the borehole 40 and may consistently apply a side force on one side of the borehole 40, which may cause the drill bit 100 to follow a curved path through the formation. If the steering sub 92 includes a movable steering pad, the steering pad may be positioned in an extended position while forming the curved borehole segment.

However, in some embodiments, a bent sub and/or steering sub 92 may not be included for directional drilling. In such embodiments, the formation of a curved borehole segment may be facilitated utilizing devices and methods according to the present disclosure without utilizing a bent sub and/or steering sub 92, such as discussed herein with reference to FIGS. 12 and 13.

Figure 2:
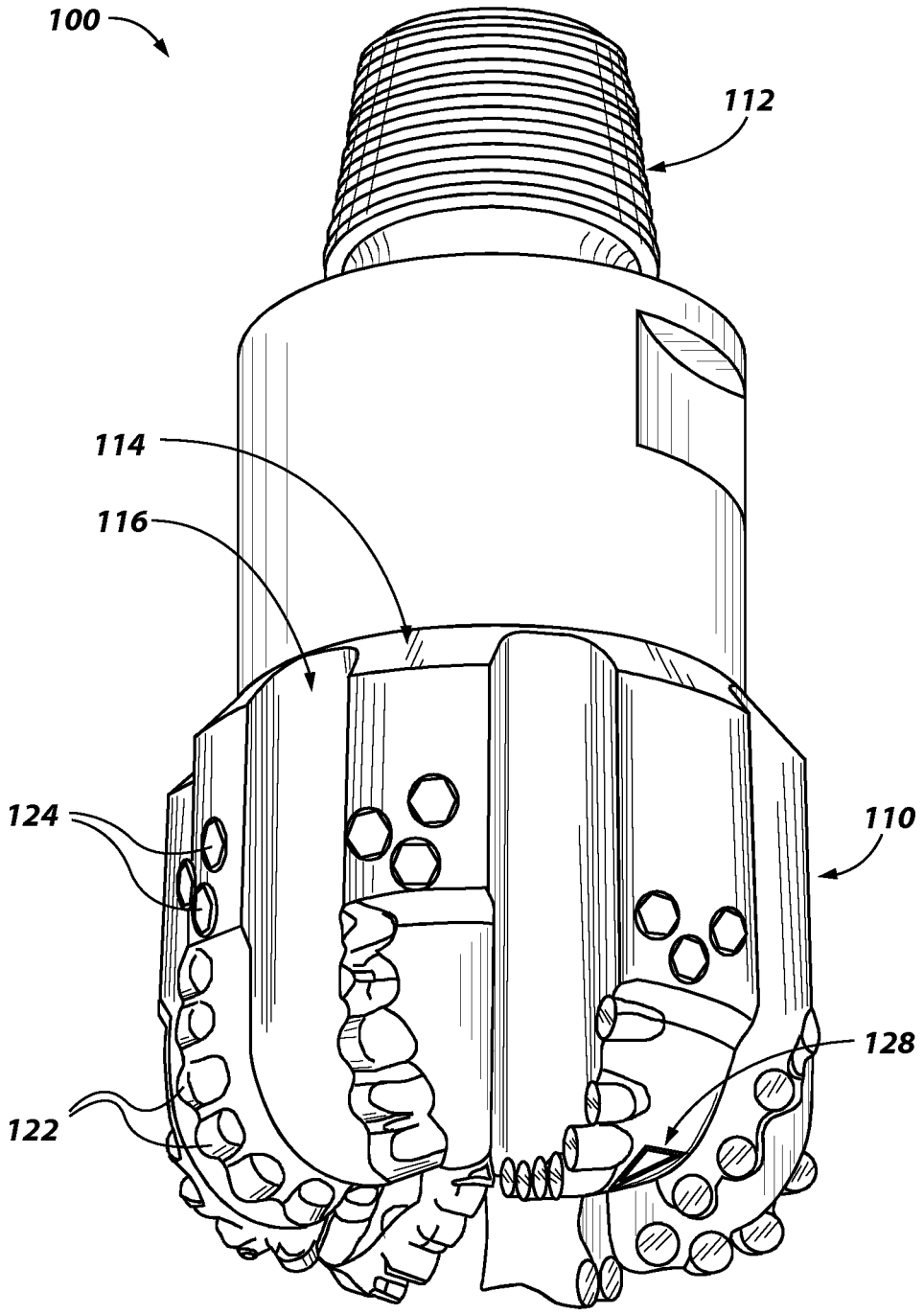
FIG. 2 shows an isometric view of a drill bit including retractable pads according to an embodiment of the present disclosure.

As shown in FIG. 2, the drill bit 100 may comprise a bit body 110 and a shank 112. The bit body 110 may include a number of blades 114 and fluid channels 116 located between the blades 114 defining an outer surface of the bit body 110. The bit body 110 may additionally include a plurality of nozzles 118 (FIG. 3), which may be located on the bit body 110 to direct fluid through the fluid channels 116. The blades 114 may include a plurality of cutting structures 122 (e.g., polycrystalline diamond compact (PDC) cutters), such as in a crown or face region of the drill bit 100 and the blades 114 may include wear-inhibiting structures 124 (e.g., tungsten carbide wear buttons), such as in a gage region of the drill bit 100.

Figure 3:
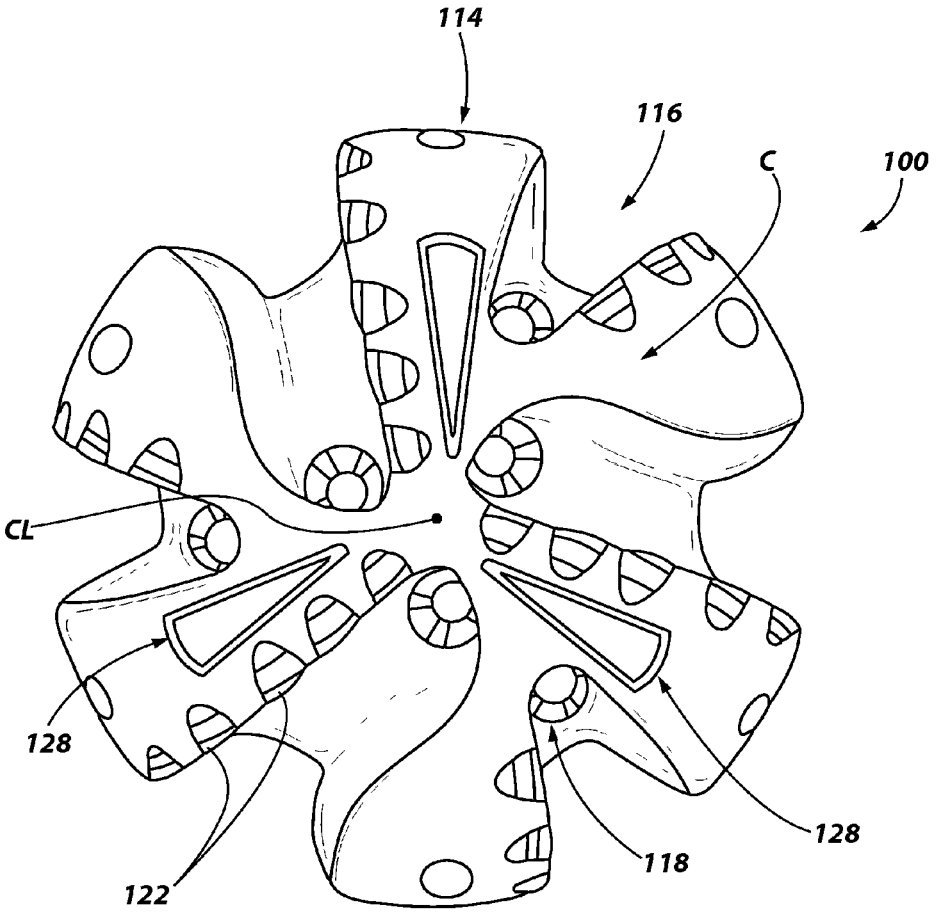
FIG. 3 shows a bottom view of the drill bit shown in FIG. 2.

As shown in FIGS. 2 and 3, the bit body 110 of the drill bit 100 may include a plurality of retractable pads 128 located on the bit face. The bit face is shown in FIG. 3, and is the leading region of the drill bit 100 that engages the bottom of a borehole during drilling operations (i.e., the portion of the bit that is opposite the shank 112). For example, each retractable pad 128 may be located on a blade 114 of the bit body 110 at a position rotationally trailing a row of cutting structures 122. In further embodiments, each retractable pad 128 may rotationally lead a row of cutting structures 122.

Figure 4A:
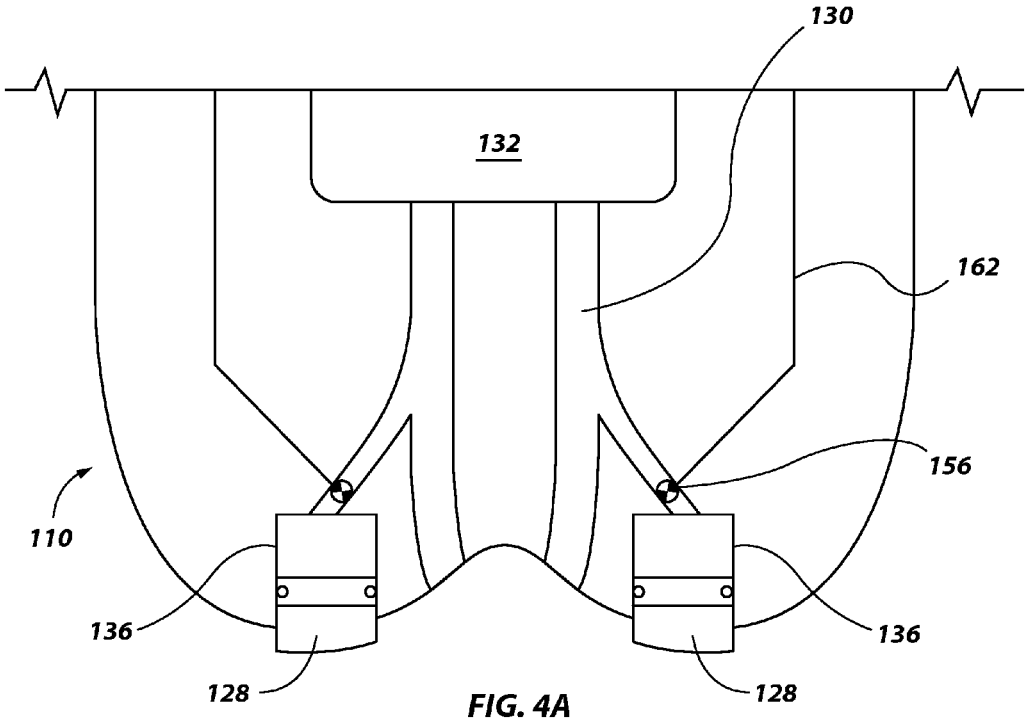
FIG. 4A shows a schematic view of a portion of the drill bit of FIG. 2, showing fluid channels through a bit body of the drill bit and showing the retractable pads in an extended position.
Figure 4B:
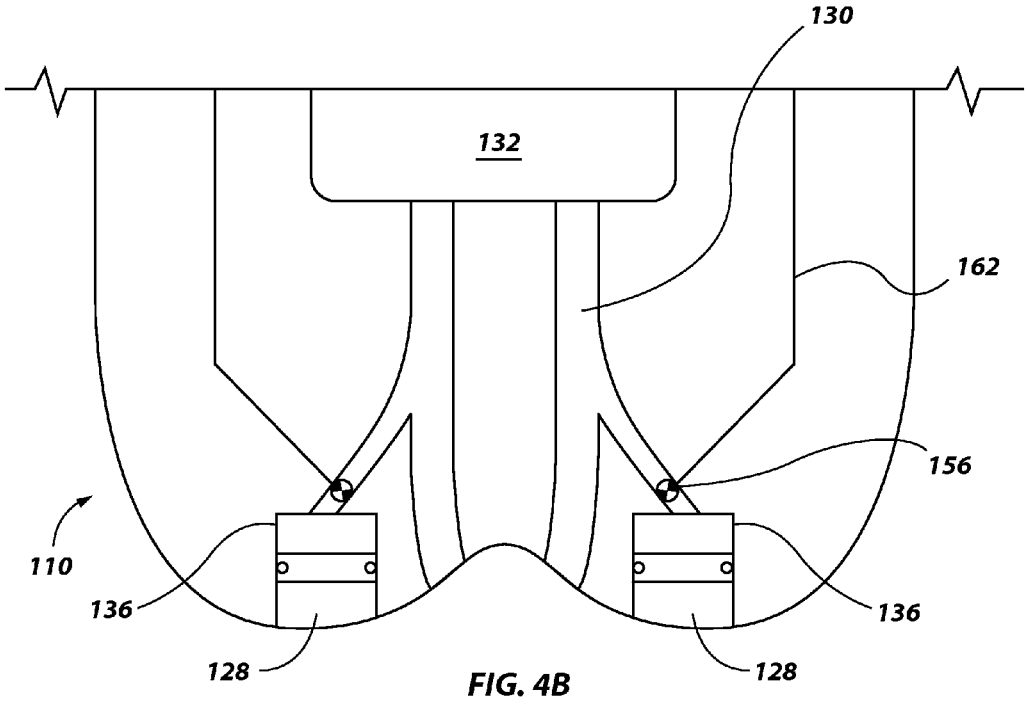
FIG. 4B shows a schematic view of the portion of the drill bit shown in FIG. 4A, with the retractable pads in a retracted position.
Figure 8:
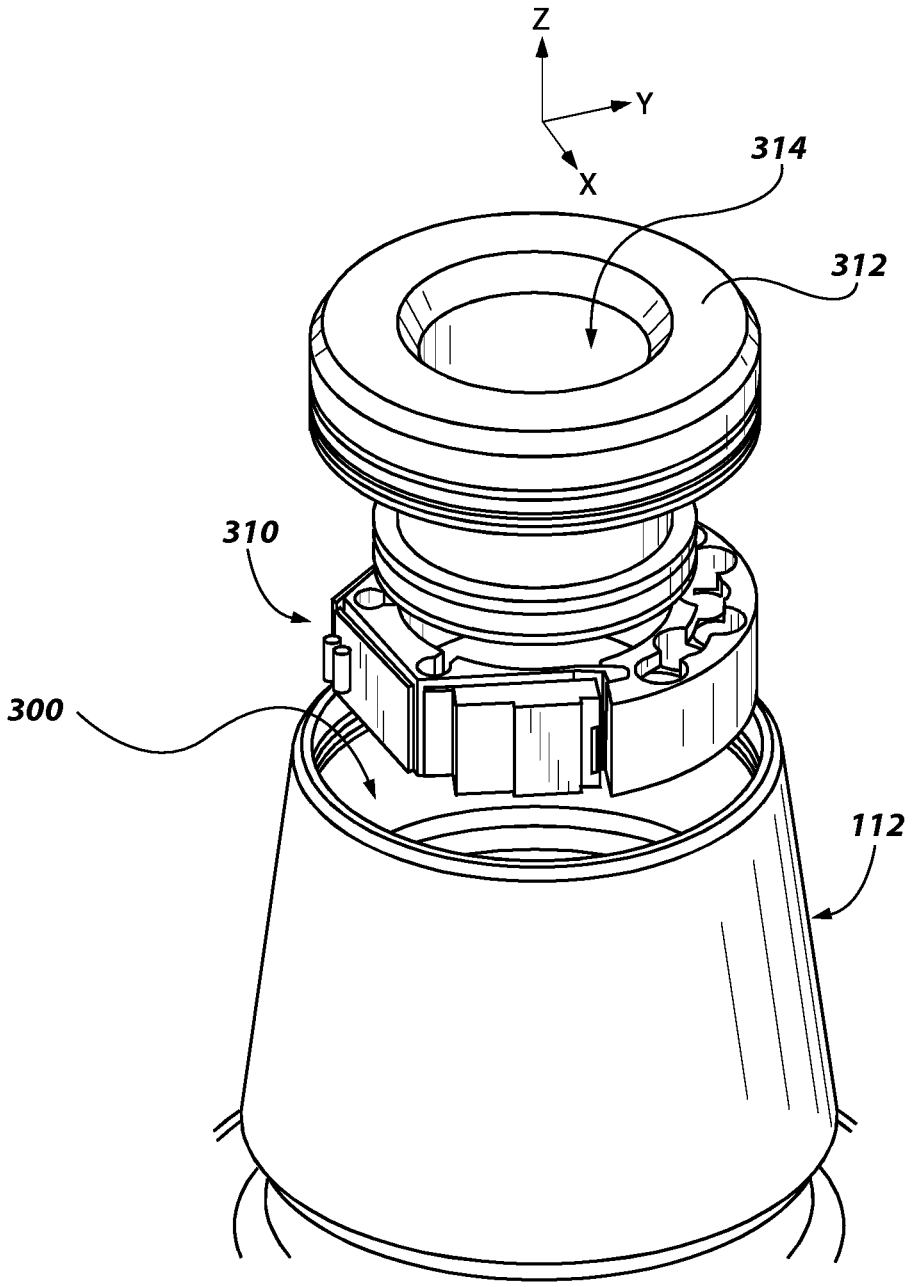
FIG. 8 shows an exploded view of a shank and an electronics module of the drill bit of FIG. 2.

As shown in FIGS. 4A and 4B, the bit body 110 may additionally include fluid channels 130 within the bit body 110, which may extend from a central fluid channel 132 to the nozzles 118 and to cavities 136 in the bit body 110 containing the retractable pads 128. The central fluid channel 132 may extend to the exterior of the drill bit 100 through an opening in the shank 112 (FIG. 8).

In some embodiments, each adjustable pad 128 may be included in a cartridge assembly 140, 180, 200, such as shown in FIGS. 5A, 5B, 6A, 6B, 7A, and 7B, which may be positioned within the cavity 136 in the blade 114 of the bit body 110.

Figure 5A:
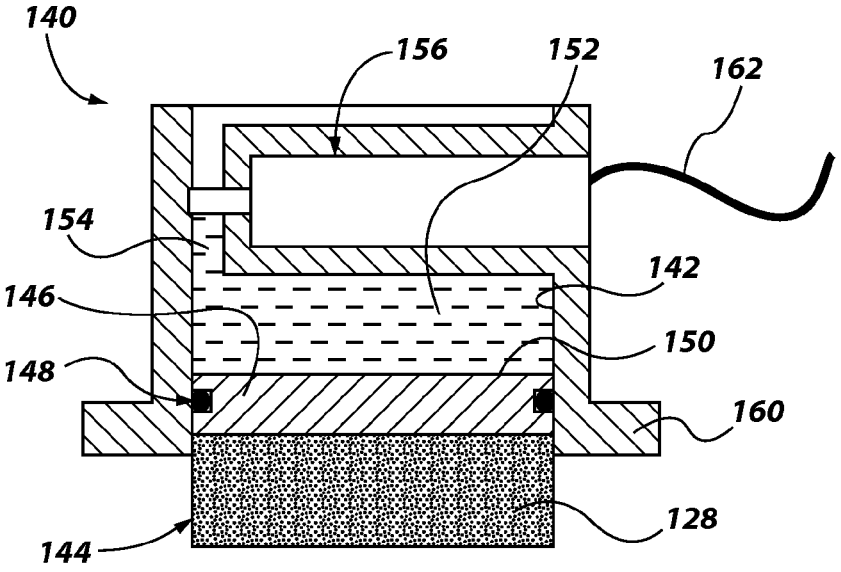
FIG. 5A shows a cartridge assembly including a retractable pad for use in a drill bit such as shown in FIG. 2, the retractable pad shown in an extended position.
Figure 5B:
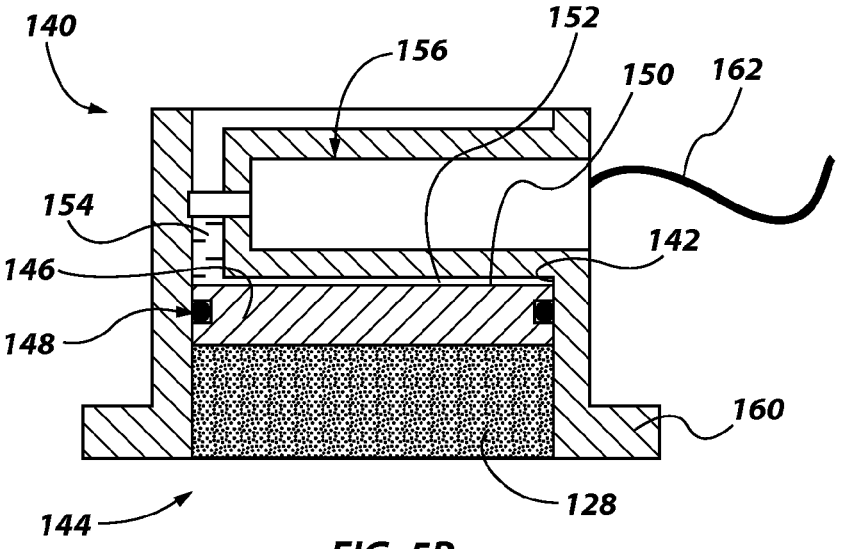
FIG. 5B shows the cartridge assembly of FIG. 5A with the retractable pad shown in a retracted position.

As shown in FIGS. 5A and 5B, a cartridge assembly 140 may include a barrel wall 142 defining a bore, a piston 144 positioned within the bore, a perimeter of the piston 144 sealed against the barrel wall 142. The piston 144 may include a carrier 146, such as a steel carrier, that may include a gland fitted with seals 148 to prevent fluid from passing between the sealed perimeter of the piston 144 and the barrel wall 142, and may also be fitted with a bearing or wear ring. The piston 144 also includes the retractable pad 128, which may be coupled to or integrally formed with the carrier 146. For example, the retractable pad 128 may be comprised of carbide, or other wear-resistant material, and may be welded or brazed to the carrier 146. Upon insertion into the bore, a surface 150 of the piston 144 and the barrel wall 142 may define a fluid reservoir 152. The cartridge 140 may further include an opening 154 to the fluid reservoir 152 and a valve 156 (such as a piezo-electric valve) located and configured to control the passage of fluid through the opening 154 to the fluid reservoir 152. As the reservoir 152 is defined by the barrel wall 142 and the surface 150 of the piston 144, the reservoir 152 may vary in size, depending upon the position of the piston 144 within the borehole. A substantially incompressible fluid may substantially fill the reservoir 152, contacting the surface 150 of the piston 144. In view of this, upon closure of the opening 154 by the valve 156, the incompressible fluid may be contained within the reservoir 152 and the piston 144 may be held in position via hydraulic pressure. Non-limiting examples of substantially incompressible fluids that may be utilized include mineral oil, vegetable oil, silicone oil, and water.

The cartridge assembly 140 may be sized for insertion into the cavity 136 of the bit body 110 (FIGS. 4A and 4B), and may include a flange 160 that may be utilized to position the cartridge assembly 140 at a predetermined depth within the cavity 136 and may also be utilized to join the cartridge assembly 140 to the bit body 110. For example, the flange 160 may be welded to the face of the drill bit 100 (FIG. 2), which may maintain the cartridge assembly 140 within the bit body 110 and also may provide a fluid-tight seal between the cartridge assembly 140 and the bit body 110. Additionally, wiring 162 may be provided and routed through the bit body 110 to provide electrical communication between the valve 156 and an electronics module 310 (described in further detail herein with reference to FIGS. 8-11).

Figure 6A:
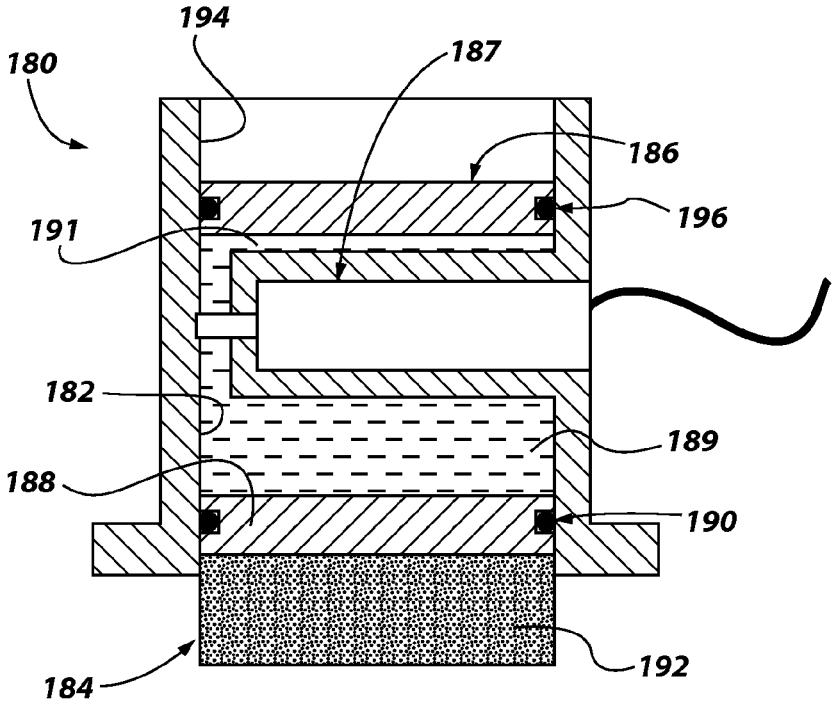
FIG. 6A shows a cartridge assembly including a retractable pad and a second piston for use in a drill bit such as shown in FIG. 2, the retractable pad shown in an extended position.
Figure 6B:
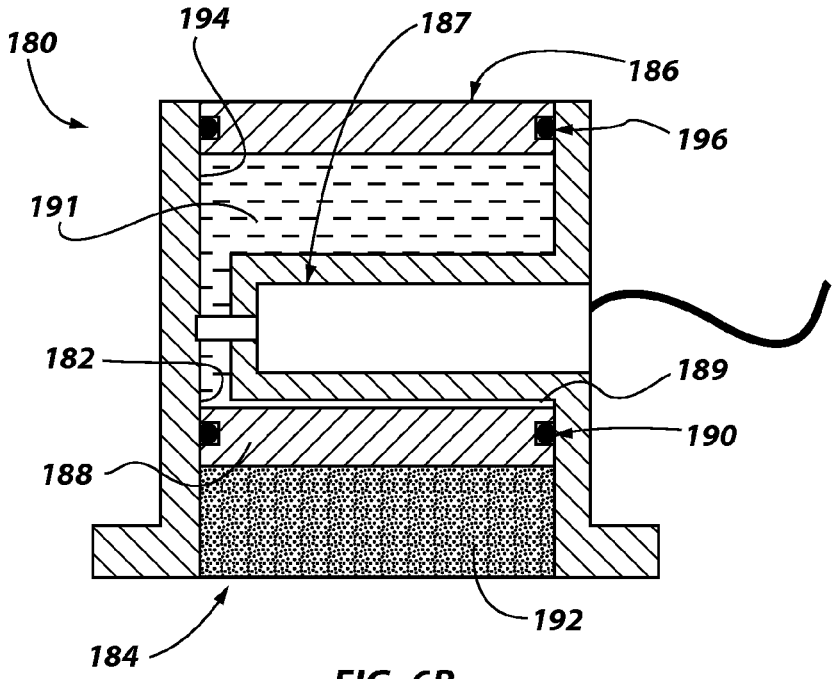
FIG. 6B shows the cartridge assembly of FIG. 6A with the retractable pad shown in a retracted position.

In another embodiment, shown in FIGS. 6A and 6B, a cartridge assembly 180 may include a first barrel wall 182 defining a first bore and a first piston 184 positioned within the bore, a perimeter of the first piston 184 sealed against the first barrel wall 182. Additionally, the cartridge assembly 180 may include a second piston 186, and a valve 187 positioned between the first and second pistons 184 and 186, respectively, and configured to regulate flow between a first reservoir 189 and a second reservoir 191.

Similar to the piston 144 of the cartridge assembly 140, depicted in FIGS. 5A and 5B, the first piston 184 of the cartridge assembly 180 may include a carrier 188, such as a steel carrier, that may include a gland fitted with seals 190 to prevent fluid from passing between the perimeter of the first piston 184 and the first barrel wall 182, and may also be fitted with a bearing or wear ring. The first piston 184 may also include a retractable pad 192, which may be coupled to or integrally formed with the carrier 188.

The second piston 186 may be positioned within a second bore defined by a second barrel wall 194, a perimeter of the second piston 186 sealed against the second barrel wall 194. The second piston 186 may also include a seal 196, such as one or more of an O-ring, a quad ring, a square ring, a wiper, a backup ring, and other packing, which may provide a seal between the second piston 186 and the second barrel wall 194.

Although in the embodiment shown in FIGS. 6A and 6B shows the surfaces of the first and second pistons 184 and 186, respectively, exposed to the incompressible fluid and the drilling fluid having similar sizes, the surface areas of the opposing surfaces of the second piston 186 may be sized differently, such as to provide a pressure multiplier to increase the pressure of the incompressible fluid relative to the pressure applied by the drilling fluid. Additionally, the size and surface areas of the first piston 184 may be different than the size and surface areas of the second piston 186.

Figure 7A:
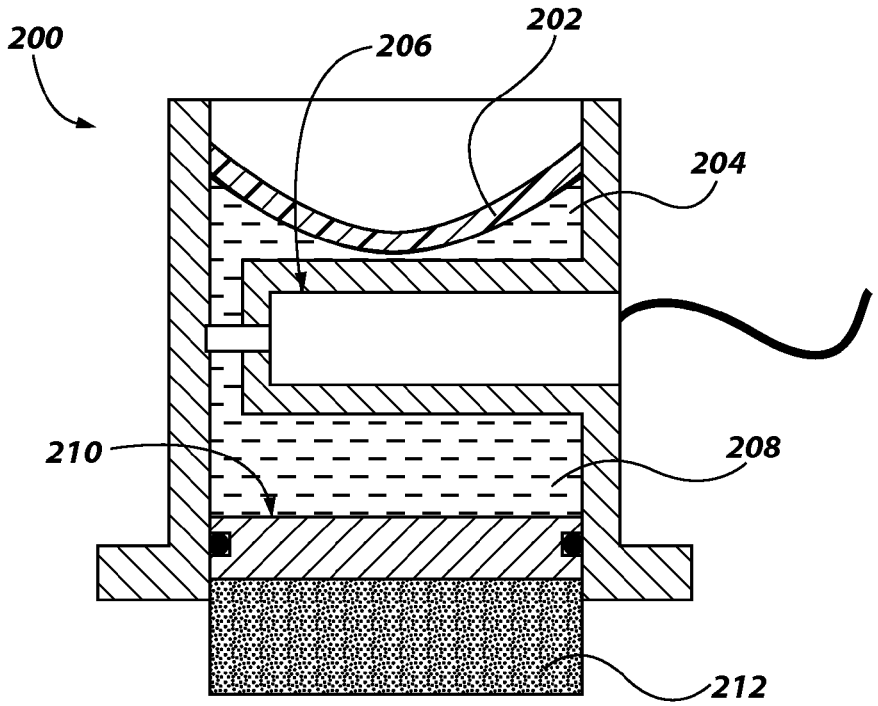
FIG. 7A shows a cartridge assembly including a retractable pad and a diaphragm for use in a drill bit such as shown in FIG. 2, the retractable pad shown in an extended position.
Figure 7B:
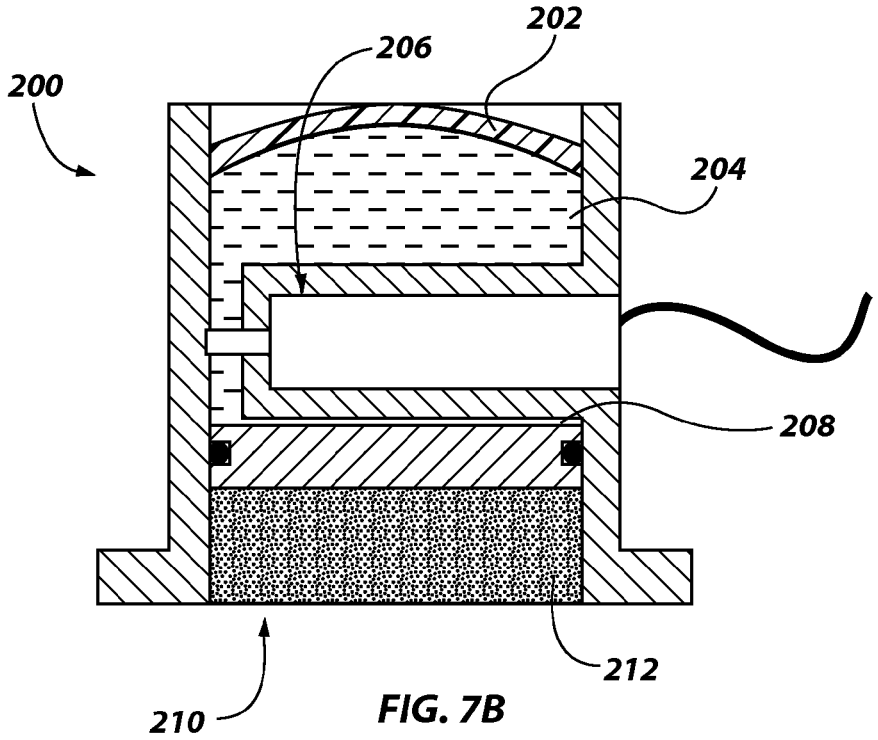
FIG. 7B shows the cartridge assembly of FIG. 7A with the retractable pad shown in a retracted position.

In yet further embodiments, a cartridge assembly 200 may include a flexible diaphragm 202 to provide an expandable fluid reservoir 204, as shown in FIGS. 7A and 7B. For example, an elastomeric member may be positioned over an end of the cartridge assembly 200 and provide a fluid barrier, yet still allow for fluid pressure to be communicated from the drilling fluid within the bit body 110 (FIG. 2) through a valve 206 to a first reservoir 208 behind a piston 210 including a retractable pad 212.

As shown schematically in FIGS. 4A and 4B, the fluid channels 130 in the bit body 110 may connect the central fluid channel 132 of the drill bit 100 (FIG. 2) to the cavity 136 containing the retractable pad 128. In view of this, the fluid channels 130 may provide fluid communication between the central fluid channel 132 of the drill bit 100 to a cartridge 140, 180, 200, such as described with reference to FIGS. 5A, 5B, 6A, 6B, 7A, and 7B, positioned within the cavity 136. A valve may selectively allow fluid communication between the central fluid channel 132 and the retractable pad 128. For example, a valve such as valve 156, 187, 206 described with reference to the cartridges 140, 180, 200 may be utilized to selectively allow fluid communication between the central fluid channel 132 and the retractable pad 128, 192, 212. The valve 156, 187, 206 may be electrically actuated (e.g., a piezo-electric valve) and may be in electrical communication with and operated by an electronics module 310 that may be located in the shank 112 of the drill bit 100 such as described in U.S. patent application Ser. Nos. 12/367,433, now U.S. Pat. No. 8,100,196, issued Jan. 24, 2012, and 12/901,172, now U.S. Pat. No. 7,987,925, issued Aug. 2, 2011, and U.S. Pat. Nos. 7,497,276; 7,506,695; 7,510,026; 7,604,072; and 7,849,934, each to Pastusek et al., each titled "METHOD AND APPARATUS FOR COLLECTING DRILL BIT PERFORMANCE DATA," and each assigned to the assignee of the present application, the disclosure of each of which is incorporated by reference herein in its entirety.

As shown in FIG. 8, the shank 112 includes a central bore 300 formed through the longitudinal axis Z of the shank 112. In conventional drill bits, a central bore is configured for allowing drilling mud to flow therethrough. In this embodiment, at least a portion of the central bore 300 of the shank 112 is given a diameter sufficient for accepting an electronics module 310, which may be configured as a substantially annular ring. Thus, the electronics module 310 may be placed within the central bore 300, about the end-cap 312, which extends through the inside diameter of the annular ring of the electronics module 310 to create a fluid tight annular chamber with the wall of central bore 300 and seal the electronics module 310 in place within the shank 112.

Figure 9:
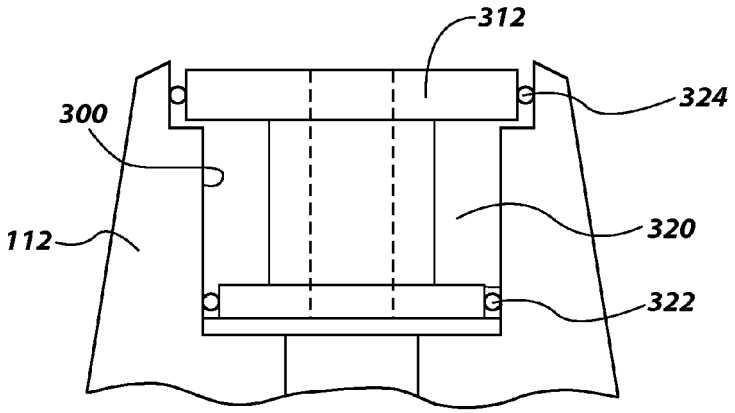
FIG. 9 shows a cross-sectional view of the shank of FIG. 8.

The end-cap 312 includes a cap bore 314 formed therethrough, such that drilling mud may flow through the end-cap 312, through the central bore 300 of the shank 112 to the other side of the shank 112, and then into the central fluid channel 132 of drill bit 100. FIG. 9 shows a cross-sectional view of the end-cap 312 disposed in the shank 112 without the electronics module 310, illustrating an annular chamber 320 formed between the end-cap 312 and the walls of the central bore 300 of the shank 112. A first sealing ring 322 and a second sealing ring 324 form a protective, fluid tight, seal between the end-cap 312 and the wall of the central bore 300 to protect the electronics module 310 (FIG. 8) from adverse environmental conditions. The protective seal formed by the first sealing ring 322 and the second sealing ring 324 may also be configured to maintain the annular chamber 320 at approximately atmospheric pressure.

In some embodiments, the first sealing ring 322 and the second sealing ring 324 may be formed of material suitable for a high-pressure, high-temperature environment, such as, for example, a Hydrogenated Nitrile Butadiene Rubber (HNBR) O-ring in combination with a PEEK back-up ring. Additionally, the end-cap 312 may be secured to the shank 112 by a number of connection mechanisms such as, for example, a secure press-fit utilizing sealing rings 322 and 324, a threaded connection, an epoxy connection, a shape-memory retainer, a weld, and a braze.

Figure 10:
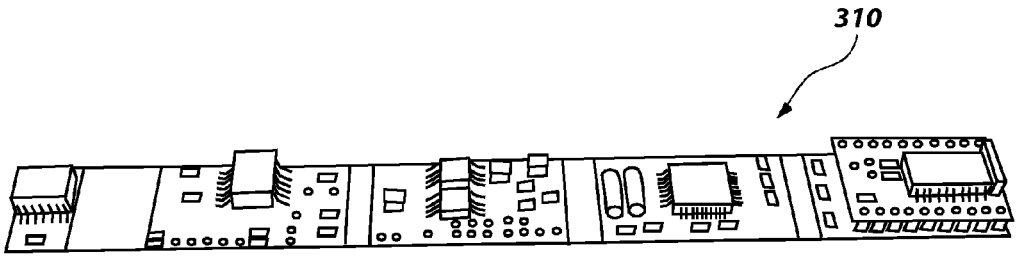
FIG. 10 shows a perspective view of the electronics module of FIG. 8.

The electronics module 310, may be configured as a flex-circuit board, shown in a flat configuration in FIG. 10. The flex-circuit board configuration may facilitate the bending and shaping of the electronics module 310 into a generally annular ring-shape, as shown in FIG. 8, suitable for disposition about the end-cap 312 and into the central bore 300. The flex-circuit board may include a high-strength reinforced backbone (not shown) to facilitate the reliable transmission of acceleration forces to sensors of the electronics module, such as accelerometers. Additionally, other areas of the flex-circuit board, which may bear non-sensor electronic components, may be attached to the end-cap 312 in a manner suitable for at least partially attenuating acceleration forces resulting from drilling operations by utilizing a material such as a visco-elastic adhesive.

In addition to operating valves 156, 187, 206 to control fluid communication between the central fluid channel 132 and the retractable pads 128, 192, 212, the electronics module 310 may be configured to perform a variety of data collection and/or data analysis functions.

Figure 11:
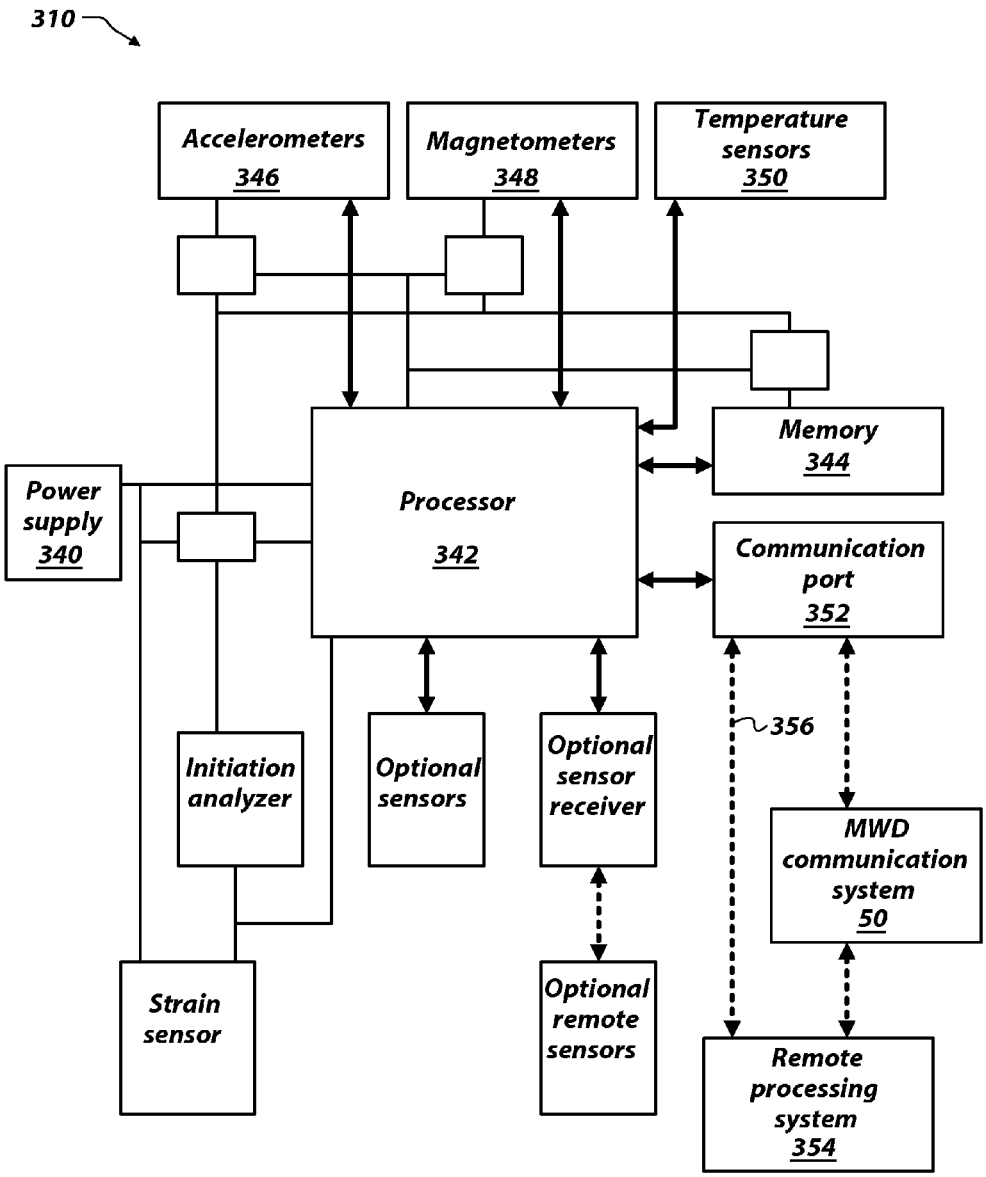
FIG. 11 shows a schematic diagram of the electronics module of FIG. 8.

In some embodiments, such as shown in FIG. 11, the electronics module 310 may include a power supply 340 (e.g., a battery), a processor 342 (e.g., a microprocessor), and a memory device 344 (e.g., a random-access memory device (RAM) and read-only memory device (ROM)). The electronics module 310 may additionally include at least one sensor 346, 348, 350 configured for measuring physical parameters related to the drill bit, which may include drill bit condition, drilling operation conditions, and environmental conditions proximate to the drill bit. In one embodiment, the sensors 346, 348, 350 may include an acceleration sensor 346, a magnetic field sensor 348, and a temperature sensor 350.

The acceleration sensor 346 may include three accelerometers configured in an orthogonal arrangement (i.e., each of the accelerometers may be arranged at a right angle relative to each of the other accelerometers). Similarly, the magnetic field sensor 348 may include three magnetometers configured in an orthogonal arrangement (i.e., each of the magnetometers may be arranged at a right angle relative to each of the other magnetometers). Although orthogonal arrangements (e.g., Cartesian coordinate system) utilizing three sensors are described herein, other numbers of sensors and arrangements may also be utilized.

A communication port 352 may also be included in the electronics module 310 for communication to external devices such as a MWD communication system 50 and a remote processing system 354. The communication port 352 may be configured for a direct communication link 356 to the remote processing system 354 using a direct wire connection or a wireless communication protocol, such as, by way of example only, infrared, BLUETOOTH®, and 802.11a/b/g protocols. Using the direct communication link 356, the electronics module 310 may be configured to communicate with a remote processing system 354 such as, for example, a computer, a portable computer, and a personal digital assistant (PDA) when the drill bit 100 is not downhole. Thus, the direct communication link 356 may be used for a variety of functions, such as, for example, to download software and software upgrades, to enable setup of the electronics module 310 by downloading configuration data, and to upload sample data and analysis data. The communication port 352 may also be used to query the electronics module 310 for information related to the drill bit 100, such as, for example, bit serial number, electronics module serial number, software version, total elapsed time of bit operation, and other long term drill bit data, which may be stored in the memory device 344.

As the valves 156, 187, 206 may be located within the bit body 110 of the drill bit 100 and the electronics module 310 that operates the valves 156, 187, 206 may be located in the shank 112 of the drill bit 100, the control system for the retractable pads 128, 192, 212 may be included completely within the drill bit 100.

In some methods of operation of the drill bit 100, the retractable pads 128, 192, 212 of the drill bit 100 may be initially positioned in an extended position, such as a fully extended position, as shown in FIGS. 5A, 6A, and 7A. With the retractable pads 128, 192, 212 positioned in an extended position, a curved borehole segment may be formed with the drill bit 100 using directional drilling techniques, such as to transition from a vertical borehole segment to a horizontal orientation. In the extended position, the retractable pads 128, 192, 212 may provide a depth-of-cut limiting feature that may provide a reduced aggressiveness of the drill bit 100 that may facilitate the drilling of the curved borehole by limiting the effective exposure of cutting structures 122 adjacent the retractable pads 128, 192, 212. In one embodiment, the retractable pads are located substantially within a cone region C of the drill bit (FIG. 3), adjacent a centerline CL (FIG. 3) of drill bit 100. After the curved borehole segment is drilled within the formation, the retractable pads 128, 192, 212 may then be refracted into the bit body 110, increasing the depth-of-cut and the aggressiveness of the drill bit 100 by increasing the effective exposure of cutting structures 122 adjacent the retractable pads 128, 192, 212, which increased aggressiveness may facilitate the efficient formation of a substantially straight borehole segment, such as a horizontal borehole segment by increasing ROP for a given rotationable speed of drill bit 100.

To retract the retractable pads 128, 192, 212, a signal may be provided to the electronics module 310. In some embodiments, an acceleration of the drill bit 100 may be utilized to provide a signal to the electronics module 310. For example, the drill bit 100 may be rotated at various speeds, which may be detected by the accelerometers of the acceleration sensor 346. A predetermined rotational speed, or a predetermined series (e.g., a pattern) of various rotational speeds within a given time period, may be utilized to signal the electronics module 310 to retract the retractable pads 128, 192, 212. To facilitate the reliable detection of accelerations correlating to the predetermined rotational speed signal or signal pattern by the electronics module 310, the weight-on-bit (WOB) may be reduced, such as to substantially zero pounds (zero Kg) WOB.

In further embodiments, another force acting on the drill bit 100 may be utilized to provide a signal to the electronics module 310. For example, the drill bit 100 may include a strain gage in communication with the electronics module 310 that may detect WOB. A predetermined WOB, or a predetermined series (e.g., pattern) of WOB, may be utilized to signal the electronics module 310 to retract the retractable pads 128, 192, 212. To facilitate the reliable detection of WOB correlating to the predetermined WOB signal by the electronics module 310, the rotational speed of the drill bit 100 may be maintained at a consistent rotational speed (i.e., a consistent rotations per minute (RPM)). In some embodiments, the rotational speed of the drill bit 100 may be maintained at a speed of substantially zero RPM while sensing the WOB signal.

After the electronics module 310 detects the signal to retract the retractable pads 128, 192, 212 (e.g., accelerations correlating to the predetermined rotational speed signal or strain measured by the strain gage correlating to the predetermined WOB signal), an electric current may be provided to the valves 156, 187, 206 corresponding to the retractable pads 128, 192, 212 and the valves 156, 187, 206 may open, allowing fluid therethrough. For example, an electrical circuit may be provided between the power supply 340 (e.g., battery) of the electronics module 310 and the valves 156, 187, 206, as the valves 156, 187, 206 may require relatively little power to operate (e.g., the valves 156, 187, 206 may be piezo-electric valves that may be in a normally closed mode and each utilizes about 5 watts of power to open).

After sending the signal or signals to retract the retractable pads 128, 192, 212, weight may be applied to the drill bit 100 through the drill string 30, and a force may be applied to the retractable pads 128, 192, 212 by the underlying formation. Upon opening of the valves 156, 187, 206, the force applied to the retractable pads 128, 192, 212 by the WOB on the undrilled formation ahead of the drill bit 100 may cause the substantially incompressible fluid within the associated reservoir 152, 189, 208 to flow out of the reservoir 152, 189, 208 through the valve 156, 187, 206 and cause the retractable pads 128, 192, 212 to be retracted into the bit body 110, as shown in FIGS. 5B, 6B, and 7B. In embodiments that utilize an open cartridge assembly 140, the incompressible fluid may flow out of the reservoir 152 and mix with the drilling fluid in the bit body 110. In embodiments that utilize a cartridge assembly 180, 200 with a second reservoir 191, 204, the incompressible fluid may flow out of the first reservoir 189, 208 and into the second reservoir 191, 204, causing the volume of second reservoir 191, 204 to expand, as shown in FIGS. 6B and 7B.

In some embodiments, the retractable pads 128, 192, 212 may be extended within the borehole after they have been refracted. To extend the retractable pads 128, 192, 212 within the borehole, another signal, such as a signal similar to, or the same as, the signal to retract the retractable pads 128, 192, 212 may be provided to the electronics module 310. Upon receiving the signal, an electrical current may be provided to the valves 156, 187, 206 corresponding to the retractable pads 128, 192, 212 and the valves 156, 187, 206 may open, allowing fluid therethrough. The drill bit 100 may be positioned off of the bottom of the borehole and drilling fluid may be pumped into the central fluid channel 132 of the drill bit 100. The fluid pressure within the central fluid channel 132 of the drill bit 100 may then cause fluid to flow through the valves 156, 187, 206 and into the associated reservoirs 152, 189, 208, causing the volume of reservoirs 152, 189, 208 to expand and the retractable pads 128, 192, 212 to extend from the bit face. After the retractable pads 128, 192, 212 have been moved to the extended position, such as shown in FIGS. 5A, 6A, and 7A, the valves 156, 187, 206 may be closed to maintain the expanded volume of reservoirs 152, 189, 208, holding retractable pads 128, 192, 212 in the extended position, and drilling may commence.

In embodiments that include a second reservoir 191, 204, such as shown in FIGS. 6A, 6B, 7A, and 7B, pressure may be applied to the fluid in the second reservoir 191, 204, such as through the second piston 186 or through the flexible diaphragm 202, by the fluid within the central fluid channel 132 of the drill bit 100 and the fluid within the second reservoir 191, 204 may be flowed into the first reservoir 189, 208. In embodiments without a second reservoir 191, 204, drilling fluid may direct the incompressible fluid into the reservoir 152 (FIG. 5A). In further embodiments without a second reservoir 191, 204, drilling fluid may be utilized as the incompressible fluid. In such embodiments, wherein drilling fluid is used as the incompressible fluid, a screen or other filter medium (not shown) may be utilized to inhibit solid debris from passing through the valve 156.

Figure 12:
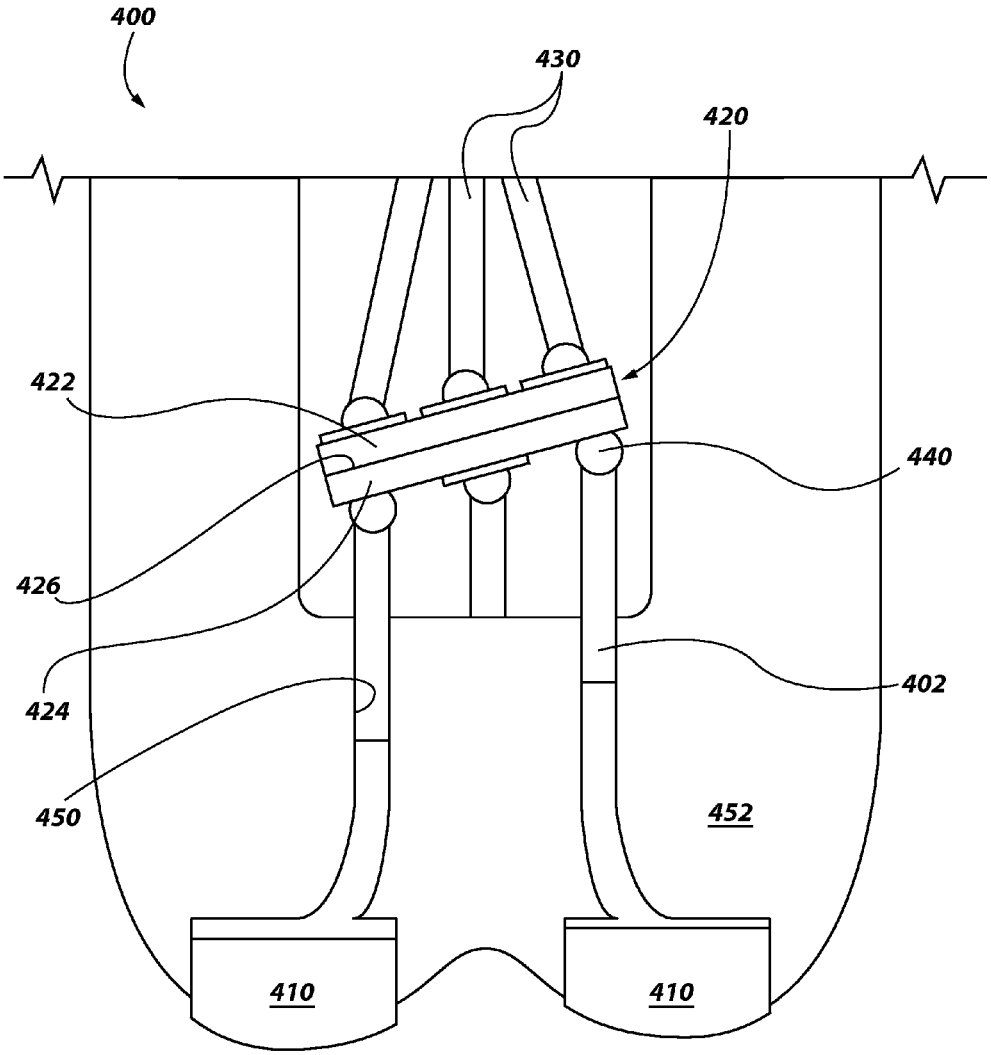
FIG. 12 shows a partial cross-sectional view of a drill bit including a swash plate according to an embodiment of the present disclosure.
Figure 13:
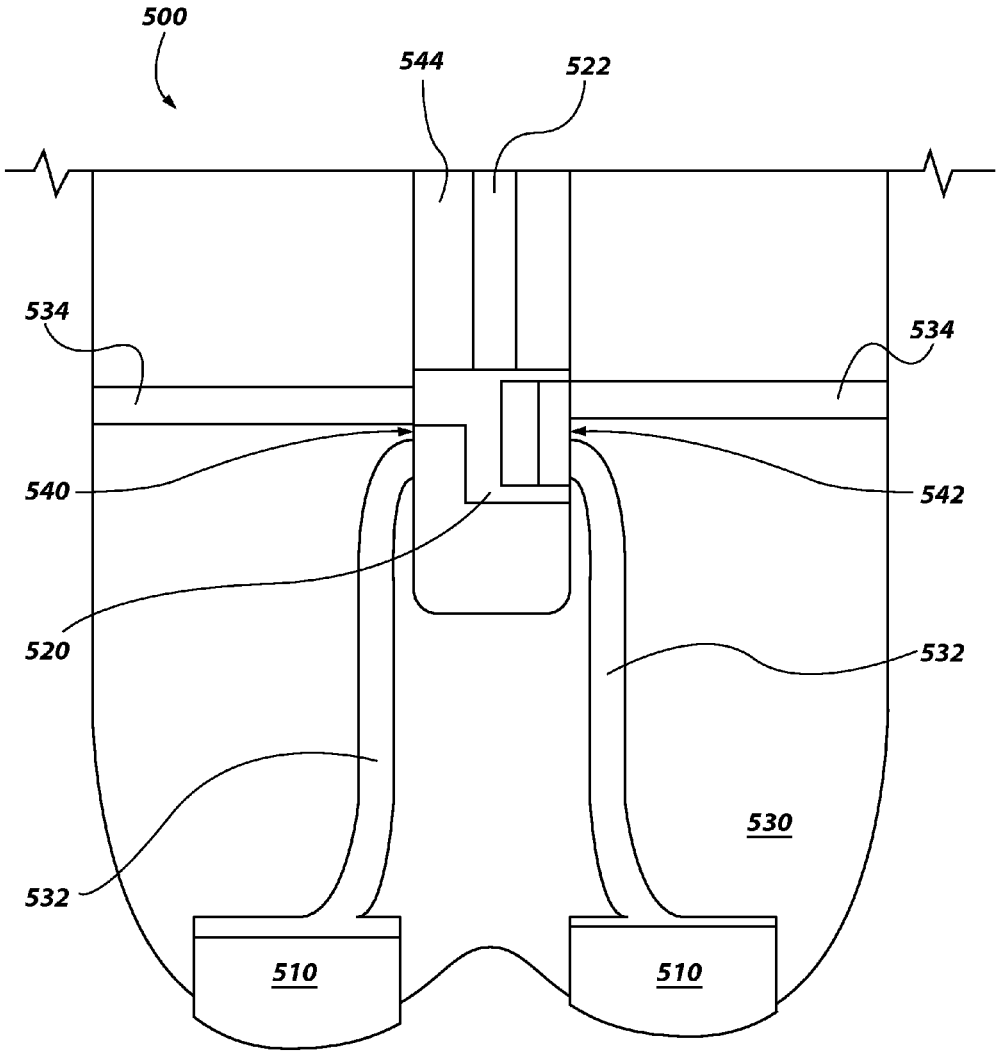
FIG. 13 shows a partial cross-sectional view of a drill bit including a valve according to an embodiment of the present disclosure.

In additional embodiments, a drill bit 400, 500 including retractable pads 410, 510 may be configured to selectively retract and extend individual retractable pads 410, 510 of the drill bit 400, 500, respectively, as shown in FIGS. 12 and 13. In such embodiments, the extension and retraction of the retractable pads 410, 510 while drilling may be utilized for the drilling of a curved borehole segment by varying the aggressiveness of cutting structures 122 (FIG. 2) in different locations on the bit face.

In some embodiments, a drill bit 400 may include a piston 402 in fluid communication with each retractable pad 410 and each piston 402 may be coupled to a swash plate 420, as shown in FIG. 12. The swash plate 420 may comprise an upper plate 422 and a lower plate 424, which rotate relative to one another at an interface 426. The upper plate 422 may not rotate relative to the borehole, and the lower plate 424 may rotate with the drill bit 400. For example, the upper plate 422 may be attached to one or more rods 430 that prevent the upper plate 422 from rotating relative to the borehole. A plurality of pistons 402 may be coupled to the lower plate 424 by a hinged connection, such as a ball-and-socket connection 440, and the lower plate 424 may rotate, along with the drill bit 400 and the pistons 402, relative to the upper plate 422. The pistons 402 may extend into bores 450 in the in a bit body 452 and be in fluid communication with the retractable pads 410.

In operation, the upper plate 422 and lower plate 424 may be tilted relative to the primary longitudinal axis of the drill bit 400, such as by manipulating one or more of the rods 430 attached to the upper plate 422, which may cause the pistons 402 to reciprocate within the bores 450 in the bit body 452 upon rotation of the drill bit 400. The reciprocating pistons 402 may then cause the retractable pads 410 to move inward and outward relative to the bit face as the drill bit 400 rotates within the borehole, as a result of hydraulic pressure forces generated by the reciprocating pistons 402 acting on the retractable pads 410. The swash plate 420 may cause the pistons 402 to move downward and cause the retractable pads 410 to extend when the retractable pads 410 pass a first side of the borehole and to move upward and cause the retractable pads 410 to retract as the retractable pads 410 pass a second side of the borehole. In view of this, the depth-of-cut for the drill bit 400 may be greater on the second side of the borehole than the first side and the drill bit 400 may remove more material from the second side of the borehole and directional drilling may be achieved. Furthermore, the direction achieved (e.g., the degree of deviation from a straight path) may be determined by the angle that the swash plate 420 is oriented relative to the primary longitudinal axis of the drill bit 400.

In further embodiments, such as shown in FIG. 13, each retractable pad 510 of a drill bit 500 may be in fluid communication with a valve 520, such as a valve similar to the valve described with reference to U.S. Pat. No. 5,553,678 to Barr et al., titled "MODULATED BIAS UNITS FOR STEERABLE ROTARY DRILLING SYSTEMS," the disclosure of which is incorporated by reference herein in its entirety. The valve 520 may be coupled to a rod 522 that may prevent the valve 522 from rotating relative to the borehole during drilling operations. A bit body 530 may include fluid channels 532 therein to provide fluid communication between the valve 520 and the retractable pads 510. Additionally, the bit body 530 may include fluid channels 534 that provide fluid communication between the valve 520 and an exterior of the drill bit 500. As shown in FIG. 13, the fluid channels 534 may provide fluid communication to the exterior of the drill bit 500 at a location at or near the gage region of the drill bit 500. In further embodiments, the fluid channels 534 may be directed downward through the bit body 530 and provide fluid communication to the exterior of the drill bit 500 through the nozzles 118, located in the face region of the drill bit 500. The fluid channels 532, 534 formed through the bit body 530 will rotate with the drill bit 500 during drilling operations, thus will rotate relative to the valve 520. The valve 520 may be configured with at least two different circumferential regions 540, 542. A first circumferential region 540 may provide fluid communication between a central fluid passage 544 in the bit body 530 and the fluid passage 532 to a retractable pad 510, while blocking fluid communication between a corresponding fluid passage 534 between the central fluid passage 544 and the exterior of the drill bit 500. A second circumferential region 542 of the valve 520 may provide fluid communication between a retractable pad 510 and an exterior portion of the drill bit 500, while preventing fluid communication between the central fluid passage 544 and either of the fluid channels 532 and 534 corresponding to the retractable pad 510.

In operation, the central fluid passage 544 of the drill bit 500 may be pressurized relative to a fluid surrounding the exterior of the drill bit 500. When the fluid channels 532 and 534 corresponding to a retractable pad 510 pass the first circumferential region 540 of the valve 520, the retractable pad 510 may be pressurized. During the pressurizing process (e.g., as the fluid channel 532 passes the first circumferential region 540 of the valve 520), the fluid channel 532 to the retractable pad 510 may be opened to the pressurized fluid within the central fluid passage 544 of the drill bit 500 and the retractable pad 510 may become extended in response to the fluid pressure. As the drill bit 500 rotates, the fluid channels 532 and 534 corresponding to the retractable pads 510 pass the second circumferential region 542 of the valve 520 and a fluid communication between the fluid channel 532 and the fluid channel 534 is provided through the valve 520, resulting in venting. During the venting process (e.g., as the fluid channel 532 passes the second circumferential region 542 of the valve 520), fluid communication is provided between a retractable pad 510 and the exterior of the drill bit 500, which may result in venting and a reduction in the pressure of the fluid in communication with the retractable pad becoming reduced and the retractable pad 510 retracting. The valve 520 may be oriented relative to a borehole to cause the retractable pads 510 to move inward at a location corresponding to a first side of the borehole and outward relative to a second side of the borehole as the drill bit 500 rotates within the borehole. In view of this, the depth of cut for the drill bit 500 may be greater on the second side of the borehole than the first side and the drill bit 500 may remove more material from the second side of the borehole and directional drilling may be achieved. Furthermore, the direction achieved (e.g., the degree of deviation from a straight path) may be determined by the position of the valve 520 relative to the borehole and the fluid pressure supplied to the central fluid passage 544 of the drill bit 500.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. A cartridge for an earth-boring tool, the cartridge comprising:

a barrel wall defining a first bore;

a piston comprising at least one retractable pad positioned at least partially within the first bore;

a first reservoir within the first bore adjacent the piston;

an opening to the first reservoir;

a valve positioned and configured to regulate fluid flow through the opening; and another barrel wall defining a second bore and having a second reservoir therein positioned for fluid communication with the first reservoir through the valve, wherein the valve is positioned between the first reservoir and the second reservoir.

2. The cartridge of claim 1, further comprising:

a second piston positioned within the second bore adjacent the second fluid reservoir.

3. The cartridge of claim 1, further comprising:

a diaphragm enclosing at least a portion of the second bore adjacent the second fluid reservoir.

4. An earth-boring drill bit, comprising:

a plurality of cavities in a face of the earth-boring drill bit;

a retractable pad coupled to a first piston located at least partially within each cavity of the plurality of cavities;

a substantially incompressible fluid in contact with the first piston and contained within a first reservoir;

a plurality of bores in fluid communication with the plurality of cavities and in contact with the substantially incompressible fluid;

a second piston located at least partially within a second reservoir in each bore of the plurality of bores;

a valve positioned between the first reservoir and second reservoir in each bore of the plurality of bores, the valve configured to selectively flow fluid between the first reservoir and the second reservoir; and a swash plate operably coupled to each second piston.

5. A method of operating an earth-boring tool, the method comprising:

drilling a borehole with an earth-boring tool with at least one retractable pad protruding from a face of the earth-boring tool adjacent at least one cutting structure;

opening a valve within the earth-boring tool to release a fluid from a first reservoir positioned beneath the at least one retractable pad and reducing the amount of protrusion of the at least one retractable pad from the face of the earth-boring tool while within the borehole;

further drilling the borehole after reducing the amount of protrusion of the at least one retractable pad from the face of the earth-boring tool;

pressurizing a fluid within the earth-boring tool while positioning the earth-boring tool off bottom;

opening the valve; and extending the at least one retractable pad.

6. The method of claim 5, further comprising sensing at least one change in rotational speed of the earth-boring tool and opening the valve in response to the sensed change in rotational speed of the earth-boring tool.

7. The method of claim 5, further comprising sensing at least one change in weight on the earth-boring tool and opening the valve in response to the sensed change in weight on the earth-boring tool.

8. The method of claim 7, further comprising, maintaining a rotational speed of the earth-boring tool while sensing the at least one change in weight on the earth-boring tool.

9. The method of claim 8, wherein maintaining the rotational speed of the earth-boring tool comprises maintaining a rotational speed that is substantially zero rotations per minute.

10. The method of claim 5, further comprising releasing fluid from the first reservoir into a drilling fluid channel of the earth-boring tool upon opening the valve.

11. The method of claim 5, further comprising releasing fluid from the first reservoir into a second reservoir upon opening the valve.

12. The method of claim 11, further comprising moving a second piston within the earth-boring tool in response to releasing the fluid from the first reservoir.

13. The method of claim 12, further comprising deflecting a diaphragm within the earth-boring tool in response to releasing the fluid from the first reservoir.

* * * * *